United States Patent [19]

Noack et al.

[11] 4,112,728

[45] Sep. 12, 1978

[54] DEVICE FOR BENDING PIPES

[75] Inventors: Rolf Noack; Joachim Schuster; Udo Lohse, all of Oberhausen, Germany

[73] Assignee: Deutsche Babcock Aktiengesellschaft, Germany

[21] Appl. No.: 872,366

[22] Filed: Jan. 26, 1978

Related U.S. Application Data

[63] Continuation-in-part of Ser. No. 715,871, Aug. 19, 1976, abandoned.

[30] Foreign Application Priority Data

Aug. 22, 1975 [DE] Fed. Rep. of Germany ..... 2537382

[51] Int. Cl.[2] ..... B21D 7/04

[52] U.S. Cl. ..... 72/154; 72/155; 72/156; 72/159

[58] Field of Search ..... 72/149–159, 72/216, 217, 218, 305, 312, 316, 318, 310, 311

[56] References Cited

U.S. PATENT DOCUMENTS

| | | | |
|---|---|---|---|
| 2,453,868 | 11/1948 | Shaw | 72/149 X |
| 2,469,406 | 5/1949 | Payne et al. | 72/217 |
| 2,690,782 | 10/1954 | Tirone | 72/154 X |
| 2,814,327 | 11/1957 | Charlton | 72/156 X |
| 3,287,952 | 11/1966 | Van Harten | 72/157 X |
| 3,299,681 | 1/1967 | Hautau | 72/150 X |
| 3,333,450 | 8/1967 | Schmidt | 72/156 |
| 3,373,587 | 3/1968 | Shubin et al. | 72/158 |

FOREIGN PATENT DOCUMENTS

| | | | |
|---|---|---|---|
| 1,227,760 | 3/1959 | France | 72/217 |
| W1,393 | 3/1956 | Fed. Rep. of Germany | 72/149 |
| 1,962,590 | 6/1971 | Fed. Rep. of Germany | 72/157 |
| 2,037,549 | 2/1972 | Fed. Rep. of Germany | 72/149 |
| 10,078 | 5/1967 | Japan | 72/217 |
| 683,965 | 12/1952 | United Kingdom | 72/153 |

*Primary Examiner*—E. M. Combs
*Attorney, Agent, or Firm*—McGlew and Tuttle

[57] ABSTRACT

The device bends pipes into a serpentine pipe bank having right-hand and left-hand bends, with the pipe being held, during the bending operation, in a bending rail and the pipe end to be bent being clamped in a bending form. The bending rail and the bending form are mounted in a cylindrical frame which is rotatable about the longitudinal axis of the pipe to be bent. After each formation of two 90° bends, or one 180° bend, the frame is rotated through 180° with the pipe remaining stationary and with the bending rail and bending form completely disengaged from the pipe. The bending rail is adjustable in the frame to fixed positions in accordance with the diameter of the pipe to be bent, and the bending form, together with clamping jaws associated therewith, is pivotally mounted in the frame for swinging about an axis perpendicular to the axis of the pipe. The bending form and the associated clamping jaws are divided, in the plane of the pipe axis, into two form parts which are moved toward and away from each other by respective cylinders to clamp and to disengage the pipe. Successive pipes are removed from a pipe magazine by a measuring carriage which grips the removed pipe and remains gripped thereto during the bending operation. The cylindrical frame has a radial recess receiving the pipe bank during the bending operation, with the pipe bank being supported on a support table.

10 Claims, 7 Drawing Figures

DEVICE FOR BENDING PIPES

CROSS-REFERENCE TO RELATED APPLICATION

This application is a continuation-in-part of application Ser. No. 715,871, filed Aug. 19, 1976, for "DEVICE FOR BENDING PIPES", abandoned.

FIELD AND BACKGROUND OF THE INVENTION

The present invention relates to a device for bending pipes to a serpentine pipe bank having right-hand and left-hand bends, in which the pipe is held, during the bending operation, in a bending rail and the pipe portion to be bent is clamped in and bent by a bending form.

DESCRIPTION OF THE PRIOR ART

In known pipe bending machines, which are capable of bending only in one direction, for example, to the right, after producing a bend, the already formed part of the pipe bank must be turned over. To this end, the non-bent pipe portion is seized by a clamping sleeve and turned through 180°. Since the pipe bank may be very long and wide, the power for this operation is used in a very uneconomical manner. In addition, during the turning over, the pipe bank must be supported and guided by the operators.

It is also well known to use special turning devices for turning the pipe bank. Such devices, however, become more complicated, the larger the extension of the pipe bank is. In such instances, in addition, the bending machine becomes less accessible.

To avoid these drawbacks, a pipe bending machine has been provided comprising separate bending mechanisms for right-hand and left-hand bends. Both bending mechanisms are mounted on a common machine frame and are moved from their rest positions into their bending positions and inversely in accordance with required bending direction. Such a construction is very expensive since all of the tools necessary for the bending operation must be doubled, and also, the time for adjusting the machine is extended, so that the advantage obtained by the fact that there is no need for turning the pipes is neutralized again.

Another known pipe bending machine is provided with a bending form operating in both directions. In this design, after a bending through 180°, the bending form and the bending rail are displaced, along a path below the bending plane, and applied against the other side of the pipe. This arrangement calls for a complicated guidance of the working tools, resulting in increased expenditures.

In order to release the pipe from engagement with the bending form, it is well known to provide a bending form which is split to the level of the pipe axis, and to lift the upper part of the form. With the bending form open, the pipe is shifted across the lower part of the form which remains in place. The sensitive bending tool is thereby subjected to increased wear. Further, in this device, the clamping jaw holding the pipe in firm engagement with the bending form is mounted separately and pressed into contact with the pipe by a separate working cylinder.

In the bending machines of the prior art, the bending tool for the bending operation proper is rotatable about a stationary vertical axis. For producing the contact pressure between the bending rail and the bending form, necessary for the bending process, the bending rail is displaced into contact with the pipe. Since the bending rail must always smoothly apply against the pipe, parallel guides are needed for the displacement of the bending rails, which again leads to increased costs.

The other pertinent prior art known to applicants includes Payne et al U.S. Pat. No. 2,469,406, Shubin et al U.S. Pat. No. 3,373,587, and German Offenlegungschrifft No. 2,037,549.

SUMMARY OF THE INVENTION

The present invention is directed to an improved bending machine of the kind mentioned above, by which the bending of pipes in a varying right-hand and left-hand direction is facilitated and, at the same time, the bending tools are simplified.

This is accomplished, in accordance with the inventon, by providing that the frame, in which the bending rail and the bending form are received, is mounted for rotation about the axis of the non-bent portion of the pipe. In this arrangement, the structure of the pipe bank, which is very unstable in itself, can remain on its provided supports, while the bending tools are brought to the opposite side of the pipe by turning the frame through 180°. This increases both the operational security and the economy of the pipe bending.

The invention further provides that the rotatable bending form is movable against the non-rotatable bending rail, which latter is not displaceable in the direction transversely to the pipe axis. This motion may be effected so that the bending form parts and the drive associated therewith, are supported on an arm which is pivotable about an axis perpendicular to the pipe axis and the free end of which is actuated by a hydraulic cylinder. This arrangement has the advantage that it can be accommodated in a small space and makes complicated parallel guidances unnecessary. In addition, the axis of the pipe portion to be bent remains constantly in the same position.

Another advantageous feature of the invention is that the bending form and the clamping jaw, which is firmly or resiliently connected thereto, are split in a horizontal plane extending to the level of the pipe axis and that both parts thus formed are movable away from each other, relative to the pipe axis. A separate working cylinder is provided for the motion of each part of the bending form and the pressues exerted by the two working cylinders differ from each other. The piston of one of the cylinders can travel up to a stop while the piston of the other cylinder can freely adjust. This buildup of the bending form has the advantage that, after the bending operation, both parts of the form can be removed from the pipe so that, thereupon, the pipe can be advanced without sliding on one of the form parts. By providing that the clamping jaw is connected to the bending form, the costs of construction are reduced.

An object of the invention is to provide an improved device for bending pipes into a serpentine pipe bank having right-hand and left-hand bends.

Another object of the invention is to provide such a bending device by which the bending of pipes into a pipe bank in a varying right-hand and left-hand direction is facilitated.

A further object of the invention is to provide such a bending device in which the bending tools are simplified.

For an understanding of the principles of the invention, reference is made to the following description of a typical embodiment thereof as illustrated in the accompanying drawings.

DESCRIPTION OF THE PREFERRED EMBODIMENT

Figure 1:
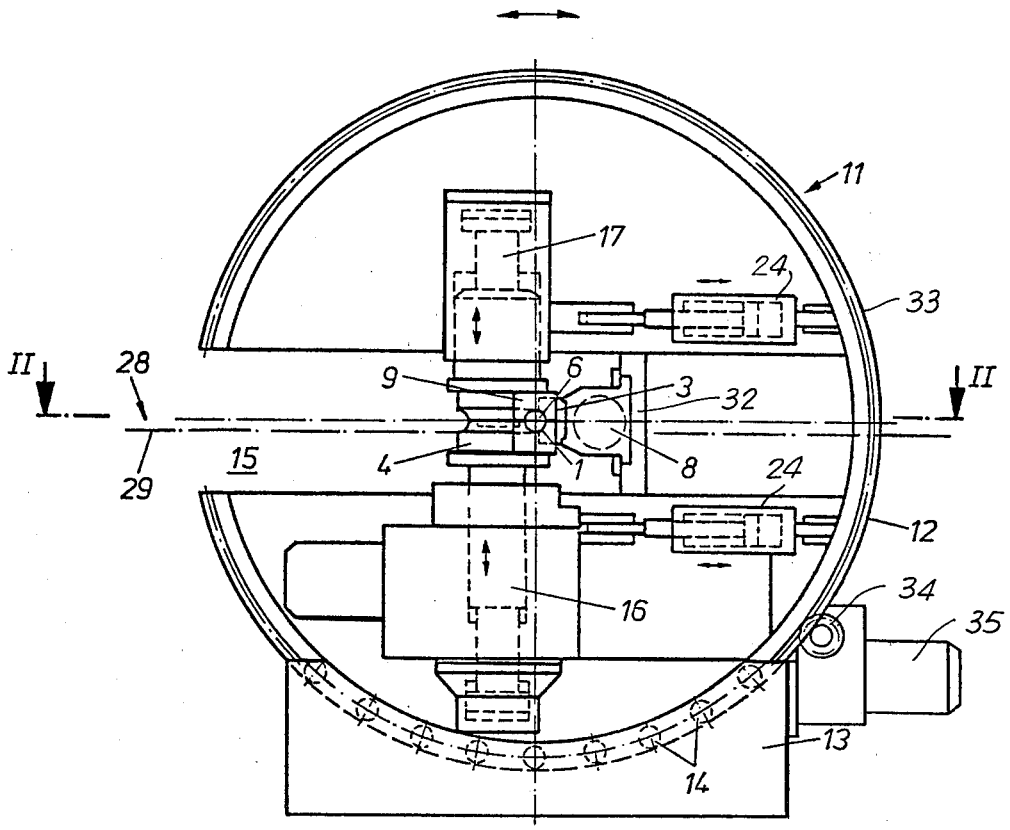
FIG. 1 is a front elevational view of a pipe bending machine in accordance with the invention.
Figure 2:
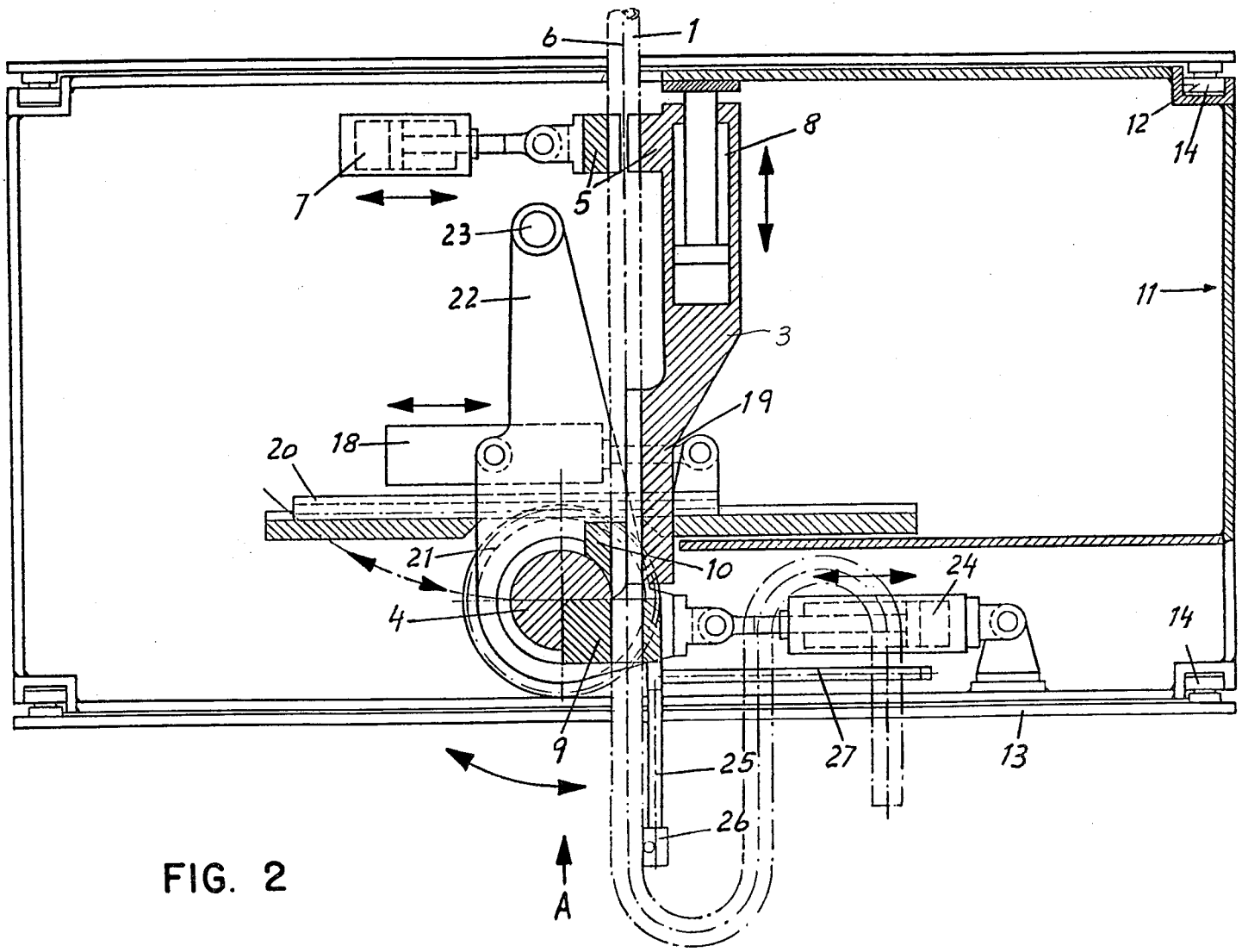
FIG. 2 is a sectional view taken along the line II-II of FIG. 1.
Figure 2B:
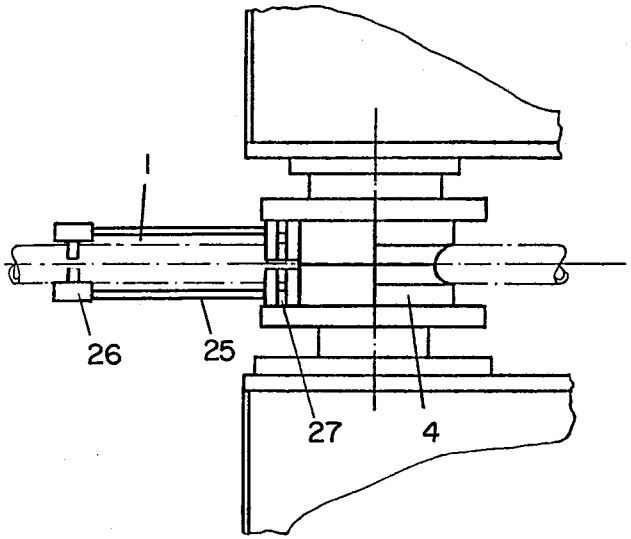
FIG. 2*b* is a partial elevation view looking toward the right side of FIG. 2*a;*
Figure 2A:
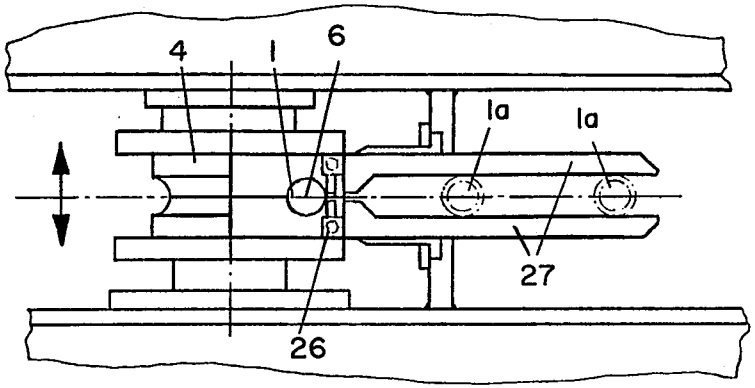
FIG. 2*a* is a partial elevation view looking in the direction of the arrow A of FIG. 2.

The illustrated pipe bending machine serves the purpose of manufacturing serpentine pipe banks having right-hand and left-hand bends. The pipes used for this purpose are stored on a pipe magazine generally indicated at 30 in FIGS. 3 and 4. A pipe 1, to be bent, is seized by a clamping sleeve of a measuring carriage, generally indicated at 2, as displaceable longitudinally of the pipe 1, and is fed to the bending tools. At the same time, a measuring device controls the travel of the measuring carriage, thereby adjusting the desired length of the respective pipe leg. During the bending operation, measuring carriage 2 remains connected to pipe 1 and is pulled along therewith. A counter of measuring carriage 2 records the actual pipe length used during the bending. In this manner, the length of the residual leg can be accurately determined.

Measuring carriage 2 is suppoted, by rollers 36, on rails 37 secured on upright supports 31 of a pipe bank supporting table 28, described more fully hereinafter. Carriage 2 includes a upwardly extending bracket 38 supporting a pipe clamp 40. Pipe clamp 40 comprises a fluid pressure linear actuator 41 whose piston rod is secured to a movable clamping sleeve 42 cooperable with a fixed clamping sleeve 43 to clamp the pipe 1 to be bent, during advancing of pipe 1 and during the bending operation. Measuring carriage 2 is moved, in the longitudinal direction of pipe 1, by means of a drive which has not been shown. During this motion, measuring carriage 2 displaces pipe 1 forwardly, or in the direction of the bending tools.

The measuring device and the counter, which are supported on measuring carriage 2, are well known in pipe bending machines, so that a detailed description is believed unnecessary. Essentially, these elements comprise a stationary gear rack fixed to the machine frame. This rack meshes with a pinion which is connected to a pulse generator secured to the measuring carriage. Such a measuring device, comprising a counter, is disclosed, for example, in U.S. Pat. No. 3,762,196, issued Oct. 2, 1973.

The bending tools consist of a non-rotatable bending rail 3 and a rotatable bending form 4, as best seen in FIGS. 1, 2, 2*a* and 2*b*. Pipe 1 is held in bending rail 3 by means of a clamping device 5 which can be opened or closed by an actuating cylinder 7, directly or through a bell crank. During the bending operation, bending rail 3 is displaced parallel to pipe axis 6, by means of a compression cylinder 8.

Bending form 4 is provided with a recess corresponding to the diameter of pipe 1. By means of clamping jaws 9, which also are conformed to the diameter of the pipe and connected to bending form 4, pipe 1 is clamped. A drive, which will be described in more detail hereinafter, provides for rotating bending form 4, whereby the desired bend of pipe 1 is formed. During the rotary motion of bending form 4, bending rail 3 pushes pipe 1, under the action of compression cylinder 8, longitudinally into bending form 4. The motions of bending rail 3 and bending form 4 are coordinated with each other so that pipe 1 is advanced by bending rail 3 more than is actually necessary for the bending proper in bending form 4. Thereby, a compression is superimposed to the bending operation.

With the progressing bending, the compression force acting in the direction of axis 6 of the pipe is still more directed to the formed bend, which may result in the bend becoming non-circular. Thereby, by means of a control device, the compressive force exerted by compresssion cylinder 8 is controlled so that, with the progress of the bending, the compressive force decreases. In order to reduce the costs of the control equipment, the compressive force is reduced by sectors of the bending circle. For example, the compression for the initial sector 0° to 90° is kept constant. For the sector from 90° to 180°, again a constant compression is used but which is smaller than in the preceding sector. At the end of the bend, the compression may be changed once more.

In addition, bending rail 3 is provided with a smoothing part 10 which applies against pipe 1. On its side applying against pipe 1, smoothing part 10 is provided with a semielliptic recess. In a well-known manner, smoothing part 10 serves the purpose of producing a smooth pipe bend.

Once the bending operation is terminated, the bending tools are released from the pipe and the pipe is advanced by the measuring carriage to produce the next bend. Any time a 180° bend or two 90° bends are produced, the next bend is to be made in the opposite direction. To this end, with pipe 1 and pipe bank 1*a* in resting position, the bending tools are disengaged from pipe 1 and swung through an angle of 180°. For this purpose, bending rail 3 and bending form 4, as well as their drives, are mounted in a cylindrical frame 11. The periphery of frame 11 is formed also be a cylindrical bearing surface 12 which forms part of a support bearing 13 comprising rollers 14 on which surface 12 runs.

Bearing surface 12 is surrounded by a toothed rim or annular gear 33 in which a pinion 34 driven by a motor 35 is engaged. By means of the drive, frame 11 is rotated from its position shown in FIG. 1 through 180° to the right or clockwise. The axis of rotation of frame 11 coincides with axis 6 of the pipe. Upon completion of a 180° bend, frame 11 is rotated again through 180° to the left or counter-clockwise, into its position shown in FIG. 1. During the rotation, the bending tools are open and the already forme pipe bank 1*a* is advanced to a position such that it cannot hinder the motion of frame 11.

Within frame 11, at that side of bending frame 4 which is remote from bending rail 3, a free passage space 15 is provided. This radially extending free passage space 15 extends axially through the entire frame 11 in that direction of pipe axis 6. During the bending operation, the already formed pipe bank 1*a* is moved through this space 15.

Frame 11 comprises a stationary guide 32 in which bending rail 3 slides. This keeps the spacing of bending rail 3 from pipe axis 6 permanently constant. The pipe magazine can be adjusted to a stationary pipe axis. Also, there is no need for expensive parallel guideways for bending rail 3. As will be explained hereinafter, the adjustment is effected by swinging bending form 4, which can be done in a substantially simpler manner.

At the level of pipe axis 6, bending form 4 is split so that two symmetrical form parts are obtained. The respective parts of clamping jaw 9, which is also split, are rigidly or resiliently connected to the associated parts of the form 4. Each part of the form 4 is acted upon by the respective separate working cylinder unit 16, 17 by which the two form parts can be displaced relative to pipe axis 6.

The piston of the upper working cylinder 17 has a larger piston surface than the piston of lower working cylinder 16. For closing bending form 4, the piston of upper working cylinder 17 travels up to a stop, i.e., up to the end of the piston stroke. Then, the piston of lower working cylinder 16 is moved up to effect the contacting of both parts of bending form 4 with pipe 1, whereby, pipe 1 is firmly clamped.

Since the effective surface of one of the pistons, namely, that of cylinder 17, is larger than that of the other piston, a differential pressure is reduced resulting in a definite position of bending form 4 at the top. Upon opening of bending form 4, the two parts of the bending form can be moved away from the pipe so far that the pipe, during the advance, does not slide on the sensitive surfaces of the recess of bending form 4, which are conformable to the pipe. This prolongs the life of the tools.

The rotation of bending form 4 is effected by a working cylinder 18 which extends transversely to pipe axis 6. Piston rod 19 of cylinder 18 actuates the bent end of a toothed rack 20 which extends parallel to cylinder 18. This toothed rack 20 meshes with gear 21 which is mounted coaxially of bending form 4 and is rigidly connected thereto. The stroke of the piston of cylinder corresponds to a complete rotary motion of bending form 4 necessary for bending the pipe through 180°, plus an allowance for the elastic recovery of the bent pipe portion.

Since, as mentioned above, bending rail 3 does not change its position relative to pipe axis 6, to obtain the necessary contact pressure for pipes having different diameters and bending radii, bending form 4 must be adjustable. For this reasn, bending form 4, along with the drive (18–21) thereof, is mounted on frame 11 for pivoting about a pivot 23 which extends perpendicularly to pipe 1. Working cylinder units 24 supported on frame 11 act on the ends of supporting arms 22, whereby bending form 4 can be displaced perpendicularly to pipe axis 6.

In order to support pipe bank 1*a* during the bending operation, respective rods 25 are secured to each of the form parts of bending form 4, and extend in the direction of pipe axis 6. By means of dogs 26, rods 25 engage the non-bent portion of the pipe from both sides.

Further, and also for supporting pipe bank 1*a* during the bending operation, respective arms 27 are secured to each of the form parts of bending form 4, extending perpendicularly to pipe axis 6. The two arms 27 apply from both sides against the already formed pipe bank 1*a*.

Figure 3:
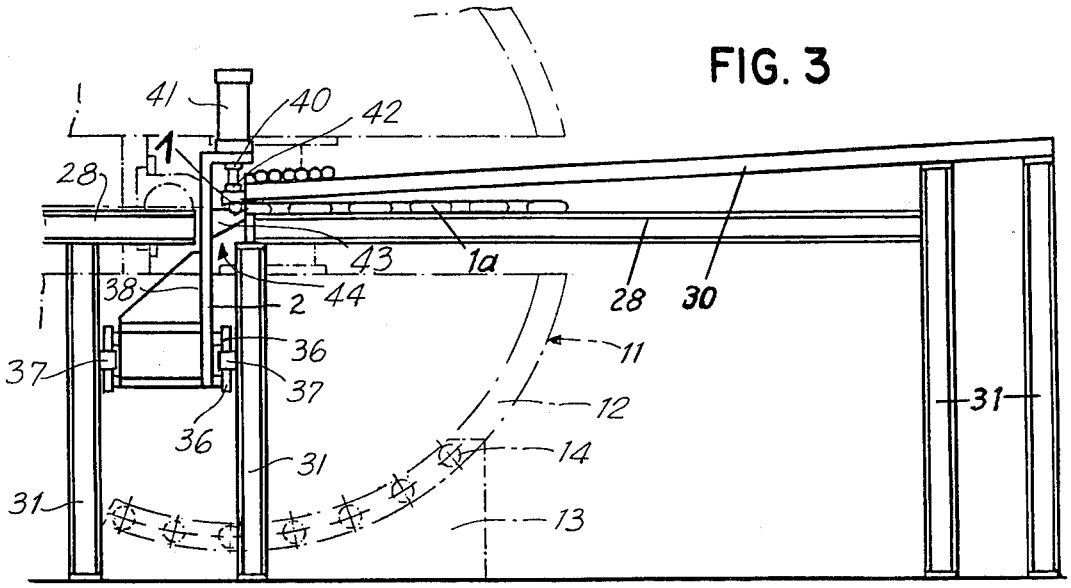
FIG. 3 is a front elevation view of the pipe magazine, the carriage and a support table.
Figure 4:
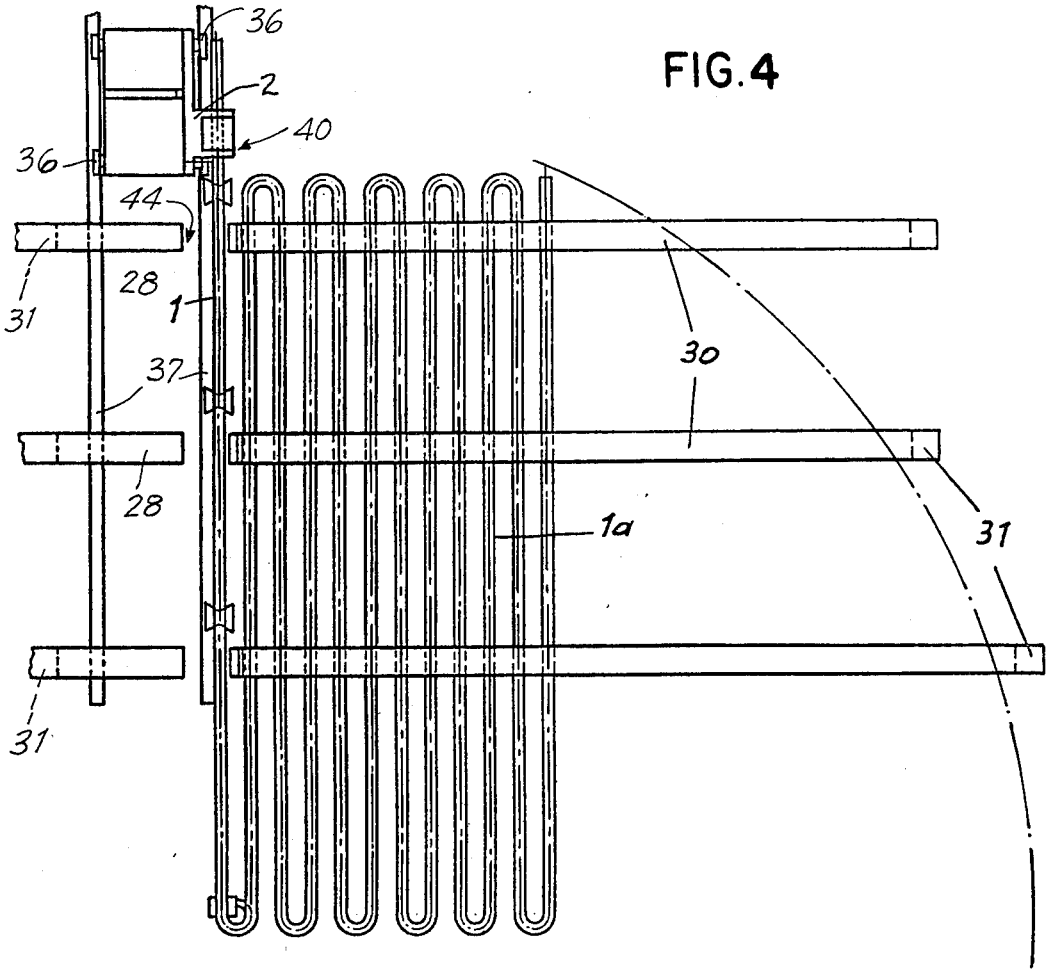
FIG. 4 is a top plan view corresponding to FIG. 3.
Figure 5:
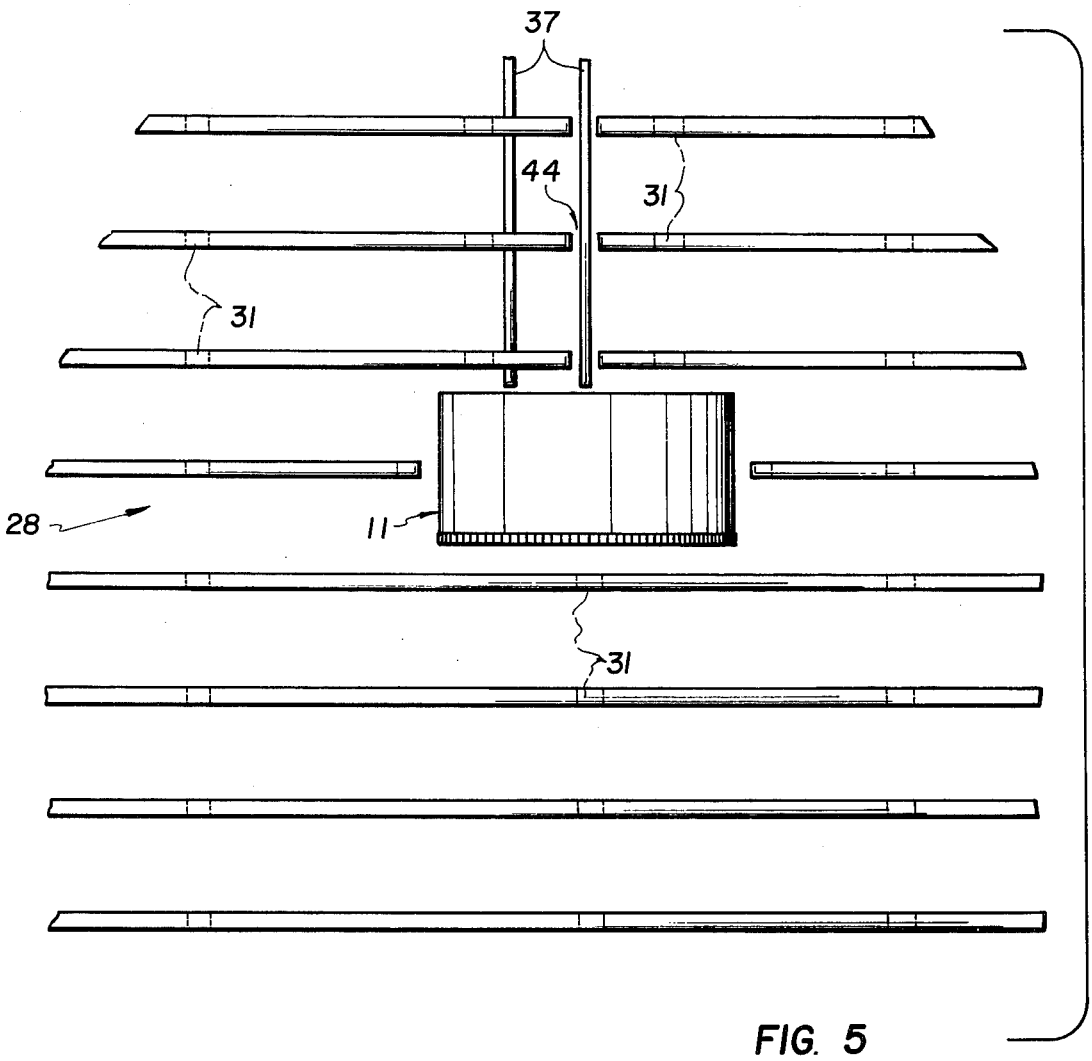
FIG. 5 is a plan view illustrating how the support table completely surrounds a cylindrical frame of the pipe bending machine.

During the bending operation, the serpentine pipe bank 1*a* is supported, for its consequent swinging movement in a horizontal plane, by a stationary horizontal supporting table 28, whose level is indicated in FIG. 1 by a dot and dash line 29. Table 28 completely surrounds the rotatable frame 11, extending laterally outwardly therefrom on all sides as best seen in FIG. 5, and is complete except for an opening 44, in the nature of a slot, extending along the feed path for the pipe 1 moving to the bending tools and in which measuring carriage 2, particularly its bracket 38 and clamping device 40 can move. As best seen in FIG. 3, table 28 extends to both the left and the right of the measuring carriage. Table 28 thus extends laterally in a horizontal plane parallel to the diameter of frame 11 and in opposite respective directions from the frame 11, as well as extending laterally, in a horizontal plane, from the opposite sides of frame 11 and parallel to the axis of pipe 1.

To understand the purpose of supporting table 28, let is be assumed that there were no supporting table for the pipe bank. Then, pipe bank 1*a* would have to be supported by the pipe portion clamped in the bending tools. Particularly with large riser pipe banks, this would result in additional forces which would be difficult to compensate or overcome. If, on the contrary, supporting table 28 is provided, during the swinging motion of the bending form, pipe bank 1*a* is guided by the horizontal supporting table 28 and thus supported thereby. As previously mentioned, after each bending operation, and with the bending tools disengaged from the pipe 1, the pipe is advanced to a position in which the already bent pipe bank 1*a* can no longer interfere with frame 11 during rotation of the latter, so that the pipe bank 1*a* does not hinder rotation of frame 11.

The pipe magazine extends above pipe axis 6. It comprises supporting bars 30 sloping in spaced relationship in the direction of pipe axis 6, and which are supported by posts 31, which also support pipe bank supporting table 28. Those posts 31 which are close to frame 11 are designed with a free passage space situated at the level of the bending plane. During formation of pipe bank 1*a*, the bank is moved through this space while supported on table 28.

The previously mentioned rods 25, provided with dogs 26, serve the purpose of increasing the lever action for swinging of the entire pipe bank 1*a* as the bending form is swung, along with the pipe to be bent. Arms 27 stabilize the very unstable structure of the pipe bank 1*a*, by providing a temporary cross-bracing between the individual straight portions of the pipe bank, while supporting table 28, as just mentioned, serves to support the pipe bank 1*a* during the swinging movement. Thus, all of the parts 25–28 serve as supports for the pipe bank 1*a* during the swinging motion involved in the bending.

The invention has been described in considering a compression-type bending machine. It may, however, be applied also to other bending machines for producing right-hand and left-hand bends, which, for example, do not use a compressive force.

While a specific embodiment of the invention has been shown and described in detail to illustrate the application of the principles of the invention, it will be understood that the invention may be embodied otherwise without departing from such principles.

We claim:

1. In a device for bending pipes into a serpentine pipe bank having alternating right-hand and left-hand bends and in which the pipe is held, during the bending opertion, on a bending rail and the pipe end to be bent is clamped in a bending form, the improvement comprising, in combination, a cylindrical frame; means mounting a single set of bending tools, consisting of a non-rotatable rail and a driven rotatable bending form, within said cyindrical frame for bending a pipe length extending coaxially through said cylindrical frame and through said bending tools; the already formed portion of a serpentine pipe bank swinging in a horizontal plane during formation of each additional pipe bend therein; stationary support means adjacent said cylindrical frame supporting the pipe bank during such swinging thereof in a horizontal plane; said cylindrical frame being formed with a radial slot accommodating the already formed portion of the pipe bank during such swinging thereof; such already formed portion being displaced horizontally out of said radial slot prior to formation of the next pipe bend; and means mounting said frame for rotation about the longitudinal axis of the pipe length to be bent without rotation of said bending form relative to said cylindrical frame and with the bending tools disengaged from the pipe length, whereby the bending tools can make alternating right-hand and left-hand bends in the pipe length without turning of the pipe length or a pipe bank including the pipe length about the longitudinal axis of the pipe length.

2. In a device for bending pipes, the improvement claimed in claim 1, in which said bending rail is fixed against displacement in a direction transverse to the axis of the pipe to be bent; and means mounting said bending form in said frame for movement toward said bending rail.

3. In a device for bending pipes, the improvement claimed in claim 2, including a drive operatively associated with said bending form to rotate said bending form; said means mounting said bending form in said frame comprising supporting arm means also supporting said drive; means mounting said supporting arm means for pivoting about an axis perpendicular to the longitudinal axis of the pipe to be bent; and a fluid pressure piston-cylinder actuator operatively connected between said frame and the free end of said arm means for effecting such pivoting.

4. In a device for bending pipes, the improvement claimed in claim 1, including a clamping jaw operatively associated with said bending form; said bending form and said clamping jaw being divided, in a horizontal plane including the axis of the pipe to be bent, into two parts; at least one of said parts being displaceable relative to the axis of the pipe to be bent.

5. In a device for bending pipes, the improvement claimed in claim 4, in which both of said parts are displaceable relative to the axis of the pipe to be bent; respective fluid pressure cylinders operatively associated with each of the two parts; the contact pressures exertable by the two cylinders being unequal to each other.

6. In a device for bending pipes, the improvement claimed in claim 5, including respective pistons displaceable in each of said cylinders; means limiting displacement of the piston of one of said cylinders in a direction to engage the associated part of the pipe; the piston of the other cylinder being freely movable in a direction to engage the associated part with the pipe to be sent.

7. In a device for bending pipes, the improvement claimed in claim 1, including two rods secured to and extending in vertically spaced relation from said bending form parallel to the axis of the pipe to be bent; and dogs on said rods engageable with the pipe portion to be bent from opposite sides thereof.

8. In a device for bending pipes, the improvement claimed in claim 1, including two arms secured to and extending in vertically spaced relation from said bending form perpendicularly to the axis of the pipe to be bent, said arms engaging the already bent portion of the pipe bank on opposite surfaces thereof.

9. In a device for bending pipes, the improvement claimed in claim 1, including a pipe magazine, for storing pipes to be bent, disposed above the bending plane of said device and defining a free passage space, above the bending plane, for the already formed pipe bank.

10. In a device for bending pipes, the improvement claimed in claim 1, including a compression cylinder operatively associated with said bending rail and operable to press said bending rail toward said bending form during bending of the pipe to exert a compression force on the pipe being bent; and means operatively associated with said compression cylinder and operable to vary the compression force exerted on the pipe by sectors through the bending circle.

* * * * *